US005323892A

United States Patent [19]

Strässler et al.

[11] Patent Number: 5,323,892

[45] Date of Patent: Jun. 28, 1994

[54] APPARATUS FOR TRANSFERRING PRINTED PRODUCTS CONVEYED IN AN OVERLAPPING STREAM

[75] Inventors: René Strässler, Jestetten, Fed. Rep. of Germany; Beat Fritsche, Greifensee, Switzerland

[73] Assignee: Grapha-Holding AG, Hergiswil, Switzerland

[21] Appl. No.: 79,269

[22] Filed: Jun. 21, 1993

[30] Foreign Application Priority Data

Jul. 8, 1992 [CH] Switzerland ..... 2153/92

[51] Int. Cl.[5] ..... B65G 47/46

[52] U.S. Cl. ..... 198/372; 198/367; 198/442; 198/457; 271/281

[58] Field of Search ..... 198/367, 369, 372, 418.8, 198/442, 457, 588, 604, 620, 626.1; 271/280, 281

[56] References Cited

U.S. PATENT DOCUMENTS 2,268,304 12/1941 Rapley ..... 198/367
3,093,236 6/1963 McLaughlin ..... 198/372 X
4,256,216 3/1981 Winters et al. ..... 198/372 X
4,566,582 1/1986 Linder ..... 198/367
4,889,463 12/1989 Frost et al. ..... 271/280 X

FOREIGN PATENT DOCUMENTS 0280156 12/1987 Japan ..... 271/280
617636 6/1980 Switzerland .
659053 12/1986 Switzerland .

*Primary Examiner*—James R. Bidwell
*Attorney, Agent, or Firm*—Spencer, Frank & Schneider

[57] ABSTRACT

The apparatus includes a removal arm which is provided at its front with two cooperating rollers to grip a printed product and with a movable flap in front of the rollers. A cylinder-piston unit can move the two cooperating rollers in the same plane and linearly to the first conveyor path. The cylinder-piston unit is controlled in such a manner that at least the extraction speed of the two cooperating rollers is proportional to the transporting speed of the first conveyor path. The apparatus is provided to serve as a turnout switch or to separate an overlapping stream of laterally offset, folded together printed products.

6 Claims, 3 Drawing Sheets

APPARATUS FOR TRANSFERRING PRINTED PRODUCTS CONVEYED IN AN OVERLAPPING STREAM

CROSS REFERENCE TO RELATED APPLICATION

This application claims the priority of Application Ser. No. CH 02 193/92-1, filed Jul. 8, 1992, in Switzerland, the subject matter of which is incorporated herein by reference.

BACKGROUND OF THE INVENTION

The present invention relates to an apparatus for transferring printed products supplied on a first conveyor path in an overlapping stream to a second conveyor path that is coplanar with the first conveyor path, with the first conveyor path including a shoulder. The device for gripping a printed product includes a removal arm equipped with two cooperating rollers that are movable between a first and a second position. A movable flap that is pivotal in the region of the shoulder between a position above the overlapping stream and a position below the overlapping stream precedes the rollers.

A device of this type is disclosed in Swiss Patent CH-A 659,053 and the corresponding U.S. Pat. No. 4,566,582. In this apparatus, the removal arm is pivotal about a vertical pivot axis between a first position and a second position. In the first position, a printed product from the overlapping stream of the first conveyor path is gripped essentially at one point between the two rollers and is transferred to the second conveyor path with a flinging movement. The drawback is here that the rollers must be aligned precisely in the diagonal of the printed product to be transferred and therefore readjustment work would be necessary for every change of format. It has also been found that the point-like gripping of the printed products makes the transfer unstable and the printed products are frequently turned sideways which may lead to jamming in the overlapping stream and quite generally to malfunctions. Moreover, the apparatus cannot be used as a turnout switch which would often be desirable in such systems. The device is also not suitable for removal of single copies for manufacturing of key bundles and for the separation of folded together printed products. This device has therefore never found acceptance in practice.

Swiss Patent CH-A 617,636 discloses a similar device in which, however, printed products to be taken out of the conveying stream are brought out of the plane of the first conveyor path in an obliquely upward direction. It has been found that the necessary reversal of the direction of the printed products to be separated is unfavorable since the overlapping stream is often interfered with. In order for a printed product to be removed from the overlapping stream, the movable component of the removal arm must be greatly accelerated at high conveying speeds. However, the result of such accelerations is that the printed product to be transferred is not gripped or is ejected again.

SUMMARY OF THE INVENTION

It is an object of the present invention to provide an apparatus of the above-mentioned type which is suitable as turnout switch, for the removal of single copies for keybundles and also for the separation of folded together printed products, and which nevertheless is reliable in operation and structurally simple. This is accomplished in an apparatus for transferring printed products that are transported in an overlapping stream on a first conveyor path to a second conveyor path that is coplanar with the first conveyor path, wherein the first conveyor path includes a shoulder and the device for gripping a printed product includes a removal arm equipped with two cooperating rollers which are movable between a first position and a second position; the rollers are preceded by a movable flap that is pivotal in the region of the shoulder between a position above the overlapping stream and a position below the overlapping stream, by the improvement according to the present invention that the two rollers are linearly movable back and forth in one plane and obliquely to the two conveyor paths.

One embodiment of the invention includes a speed controlled cylinder-piston unit with which the two cooperating rollers of the removal arm are movable linearly back and forth in the same plane and obliquely to the two conveyor paths. The cylinder-piston unit is controlled in such a way that at least the extraction speed is proportional to the conveying speed of the first conveyor path. A telescope belt is placed around each one of the two cooperating rollers and the drive rollers of these telescope belts are driven in a mechanically fixed transmission ratio by the drive of the first conveyor path.

With the apparatus according to the present invention, printed products traveling in an overlapping stream on the first conveyor path can be carefully removed in a linear, coplanar movement without acceleration. During the removal, the printed products are guided between the two telescope belts. If the conveying speed changes, the extraction speed of the removal arm is always optimally adapted to the conveying speed of the printed products to be transferred. Thus it is ensured that the printed products are not dropped by the removal arm and are unable to accumulate in the removal arm between the two telescope belts. Due to the mechanical coupling of the drive rollers with the drive of the first conveyor path it is ensured that the speed of the printed products in the direction of the first conveyor path is equal in every case to the speed of the first conveyor path. The extraction speed is automatically adapted to this speed in every case. The apparatus according to the invention can therefore be used as a turnout switch which constantly transfers the printed products from the first conveyor path to the second conveyor path.

It has been found that the apparatus according to the invention is suitable as a turnout switch, to reject misprints, to separate printed products that are folded together in an overlapping stream and also to form the so-called key bundles. It is also possible to arrange several devices next to one another and to control them in cadence to form key bundles. The apparatus according to the present invention can thus be used much more universally. Retrofitting or the performance of different functions successively in time is possible without difficulty and is easier than in the past.

Further advantageous features and modifications of the invention will become evident from the dependent claims, the description below and the drawing figures.

BRIEF DESCRIPTION OF THE DRAWINGS

One embodiment of the invention will now be described in greater detail with reference to the drawing figures, in which.

DETAILED DESCRIPTION OF THE PREFERRED EMBODIMENT

Figure 1:
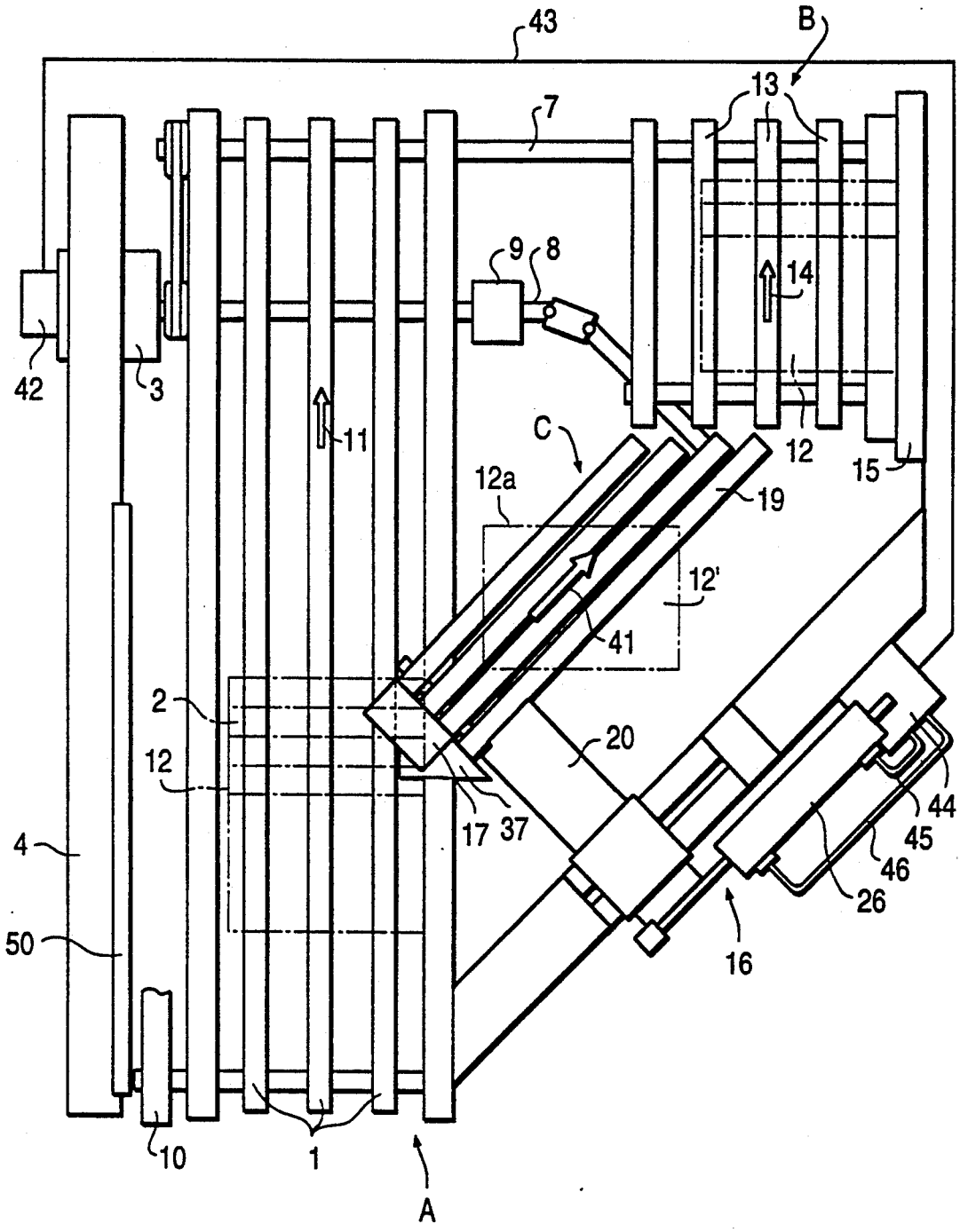
FIG. 1 is a schematic top view of an apparatus according to the invention and a first as well as a second conveyor path, with some individual components being omitted for the sake of clarity.

FIG. 1 depicts a first conveyor path A which includes a plurality of parallel arranged belts 1 which are supported on a frame 10 and are guided around a shaft 7 which is connected with a drive 3. Conveyor path A serves to transport an overlapping stream 2 of printed products, for example newspapers, in the direction of arrow 11. Such an overlapping stream is formed, for example, in a rotary printing press. The format and thickness of printed products 12 may be very different. Frequently such an overlapping stream 2 is also composed of printed products 12 which include inserts or of pairs of folded-together and laterally offset printed products. A chain channel 4 and a connecting link 50 are disposed on the sides next to belts 1.

A second conveyor path B is laterally offset relative to the first conveyor path A. It is also equipped with several belts 13 which may be driven by drive 3 by way of shaft 7. Conveyor path B transports printed products 12 disposed thereon in the direction of the arrow 14. The conveying direction of this second conveyor path B is parallel to that of the first conveyor path. Conveyor path B is provided with a lateral abutment 15 at which the sides of the printed products 12 are aligned.

Figure 2:
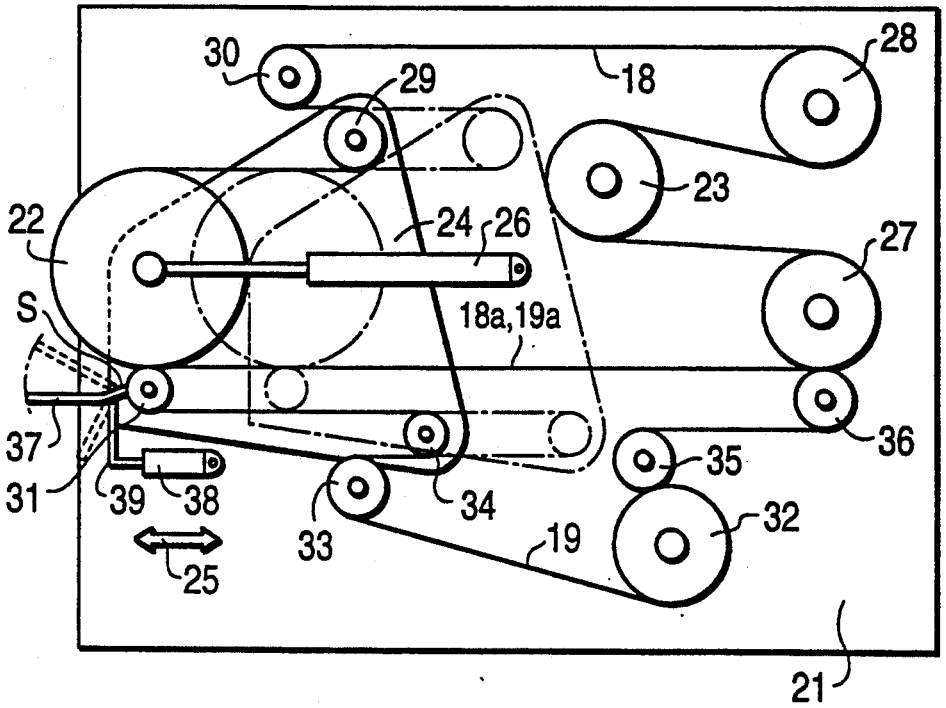
FIG. 2 is a schematic partial view of the apparatus according to the invention.

To transfer the printed products from the first conveyor path to the second conveyor path, a further conveyor path C is arranged between them so as to extend transversely thereto. This third conveyor path is formed by a device 16 which includes a frame 20 equipped with a removal arm 17. Removal arm 17 is provided with two endless telescope belts 18 and 19 which, according to FIG. 2, are arranged one above the other and are supported at a bearing plate 21. The upper telescope belt 18 runs over a roller 22 disposed at the front and over a drive roller 23. Roller 22 is supported by a carriage 24 which is able to move horizontally back and forth by means of a cylinder-piston unit 26 (FIG. 1) in the direction of the arrow 25 between a position indicated by a solid line and a position indicated by a dash-dot line. Between roller 22 and drive roller 23, telescope belt 18 is placed around reversal rollers 27 to 30. They move roller 29 together with the carriage 24.

The lower telescope belt 19 is composed of several partial belts and is placed around a roller 31 disposed at the front which cooperates with roller 22 and is likewise supported at carriage 24. Telescope belt 19 also is guided over a drive roller 32 which is supported on bearing plate 21. Between the two rollers 31 and 32, reversal rollers 33 to 36 are disposed. Roller 34 of this group is supported at carriage 24.

The two telescope belts 18 and 19 have two parallel runs 18*a* and 19*a* whose faces contact one another between rollers 22 and 27 and are movable from the left to the right in FIG. 2.

Rollers 22 and 31 are preceded by a stabbing fork 37 which is connected with roller 31 and is pivotable by means of a cylinder 38 that engages at a lever 39 of fork 37 about a pivot axis 39 into the position shown in dash-dot lines and back from this position.

As indicated schematically in FIG. 1, drive rollers 23 and 32 are connected with drive 3 by way of gears 9 and a cardan shaft 8. The speed of belts 18 and 19 is thus always proportional to the running speed of belts 1. The transmission ratio is set in such a way that the conveying speed of the two telescope belts 18 and 19 in the direction of movement of first conveyor path A is equal to the speed of this conveyor path. The speed of belts 18 and 19 is thus correspondingly higher as a function of the slope of conveyor path C relative to the others. For example, for a slope of 45° it is multiplied by $\sqrt{2}$.

Figure 5:
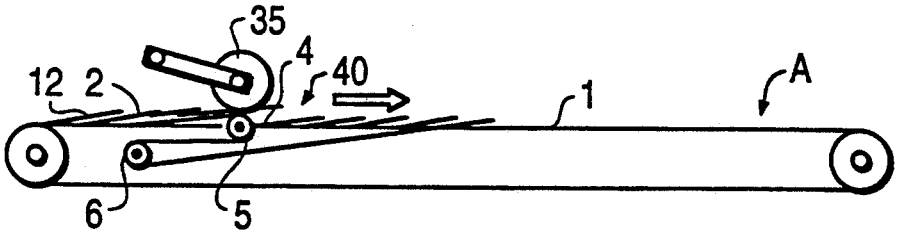
FIG. 5 is a schematic view of a conveyor path equipped with a shoulder.

Referring also to FIG. 5, in order to pick up printed products from the first conveyor path A by means of stabbing fork 37 when removal arm 17 is extended, the first conveyor path A is provided with a known shoulder 40 which is formed in a known manner by two reversal rollers 5 and 6 and a pressure roller 35. This shoulder causes the printed products 12 in the overlapping stream to be fanned open. If, with removal arm 17 extended, stabbing fork 37, in the position shown in dash-dot lines in FIG. 2 is pivoted upwardly, the printed products 12 pass through underneath stabbing fork 37. If, however, stabbing fork 37 is in its lower position, it stabs into the overlapping stream 2 and the printed product 12 disposed above fork 37 moves onto it and is gripped by the two rollers 22 and 31 and by telescope belts 18 and 19 to be transported in the direction of arrow 41 (FIG. 1) to the second conveyor path B.

FIG. 1 shows dash-dot lines a printed product 12′ that is transported in the direction of arrow 41. It is now important that the leading edge 12*a* of printed product 12′ is parallel to the corresponding edges of the overlapping stream 2 of the first conveyor path A. The retention of the orientation of the printed products 12 in the region of removal arm 17 is ensured by belts 18 and 19 gripping the surfaces of the printed products. The sequence of operation for removal of an individual printed product will now be described.

It is assumed that an overlapping stream 2 is transported on conveyor path A in the direction of arrow 11.

If an individual printed product 12 is to be removed from this overlapping stream 2, which is regularly necessary for monitoring purposes, a shoulder 40 is formed in that rollers 5 and 6 are set accordingly. Removal arm 17 is here in the extended position shown in FIG. 1 and the stabbing fork is pivoted upwardly. To grip a printed product 12, stabbing fork 37 is now pivoted downwardly. A printed product 12 disposed in front of stabbing fork 37 runs onto the latter and is gripped by the two belts 18 and 19, whereupon carriage 24 is retracted. This causes stabbing fork 37 to go out of engagement. Further printed products will thus not come between rollers 22 and 31. Stabbing fork 37 is now pivoted upwardly again and the printed product 12′ gripped at belts 18 and 19 is transferred to the second conveyor path B from where it can be removed. The second conveyor path B may here also be a container or the like.

It is significant in this connection that for such a removal of an individual item the overlapping stream is not placed into an oblique position and, in particular, a printed product following the removed printed product is not placed in an oblique position. It has been found that a very precise removal in this respect is possible if removal arm 17 moves away from the overlapping stream with controlled speed. For this purpose, the present apparatus is provided with a proportional valve 44 that is connected by way of an electrical line 43 with a tachometer 42 of drive 3. On the other hand, proportional valve 44 is connected by way of pressure conduits 45 and 46 with cylinder-piston unit 26. Due to the signals received from tachometer 42, proportional valve 44 now controls the speed of the piston of cylinder-piston unit 26 in such a way that its speed is proportional to the speed of belts 1. If thus, the speed of belts 1 is changed, and thereby the traveling speed of overlapping stream 2 changes, the extraction speed of removal arm 17 changes in proportion thereto. Since now, as already mentioned above, because of their being mechanically coupled with drive 3, the speed of belts 18 and 19 also changes proportionally to a change in the speed of belts 1, the extraction speed of removal arm 17 also changes in proportion to a change in the speed of belts 18 and 19. The optimum ratio between the two speeds is dependent upon the type of printed products 12, for example, their format, the consistency of the paper and the thickness of these printed products. This speed ratio can be set very precisely by means of proportional valve 44. Generally, the extraction speed is somewhat less than or equal to the speed of belts 18 and 19. If the extraction speed is greater than the speed of belts 18 and 19, the belts will not grip a printed product or they will drop it again. If the extraction speed is much slower than the speed of the mentioned belts, several printed products may be gripped together and this may lead to jamming in removal arm 17. The provided speed control of cylinder-piston unit 26 now ensures that the two speeds are always adapted optimally to one another. A printed product gripped at its front end by belts 18 and 19 is thus transported away from conveyor path A at precisely the correct speed, independently of the transporting speed of this conveyor path, with the orientation of the front edge being precisely maintained.

If now, with the removal arm 17 extended, the latter is not retracted and stabbing fork 37 also remains in the lower position, all printed products 12 in the region of shoulder 4 are gripped by the two belts 18 and 19 and transferred to second conveyor path B. The initially laterally offset printed products 12 are then laterally aligned by abutment 15. Device 16 here operates as a turnout switch. If the turnout switch is closed, removal arm 17 is retracted, as mentioned above, in a speed controlled manner and stabbing fork 37 is raised. Here again it is of course important that the overlapping stream 2 of the first conveyor path A is not interfered with.

The separation of an overlapping stream 2 in which the printed products 12 are composed of folded together and laterally offset products **12*a* and 12*b* will now be described with reference to FIG. 3. The arrangement essentially corresponds to that of FIG. 1 and also the device 16 for transferring printed products 12 is configured as described above. In addition, however, a pressure device 47 is provided at the left edge of the first conveyor path A as shown schematically in FIG. 4. This pressure device includes two endless belts 48 and 49 between which the products 12*b* that project laterally on the left are held at the projecting edge in the region of shoulder 40 in such a manner that the movement of the overlapping stream in the conveying direction is not influenced. However, pressure device 47 prevents the gripped printed products 12*b*** from being moved transversely to the conveying direction.

Figure 3:
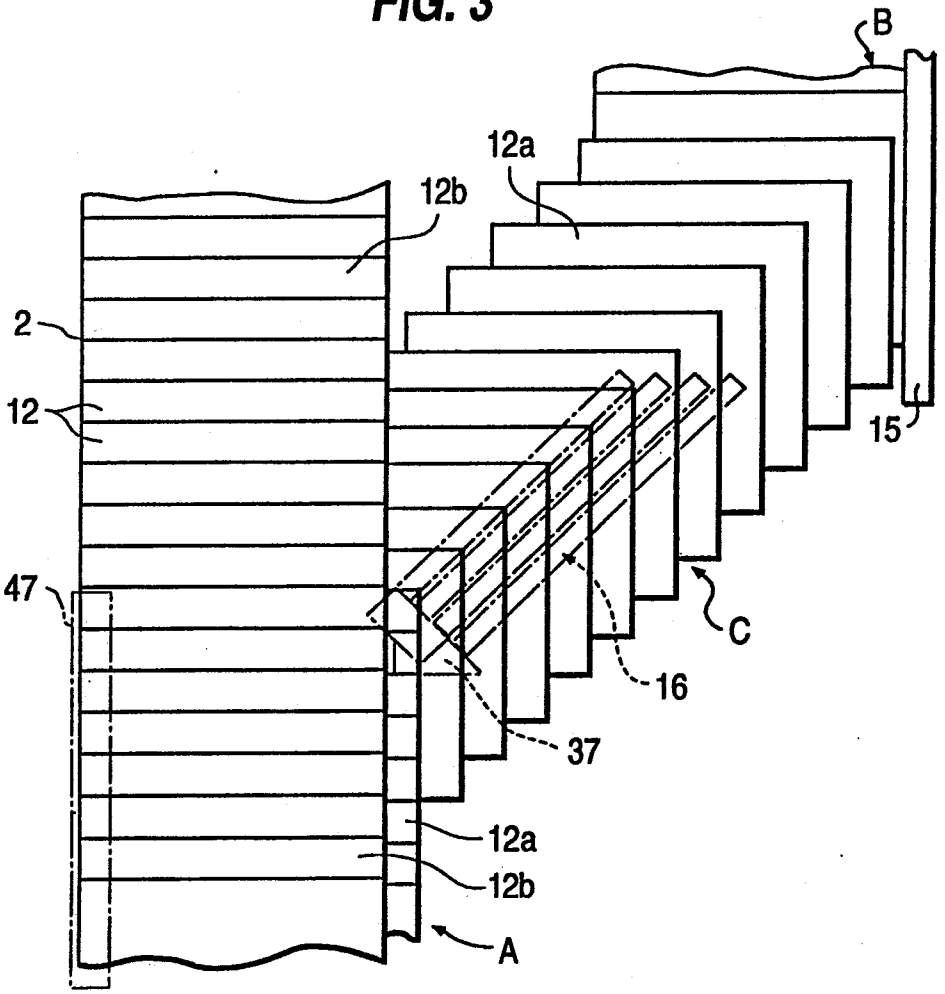
FIG. 3 is a schematic top view of an apparatus according to the invention and two conveyor paths.
Figure 4:
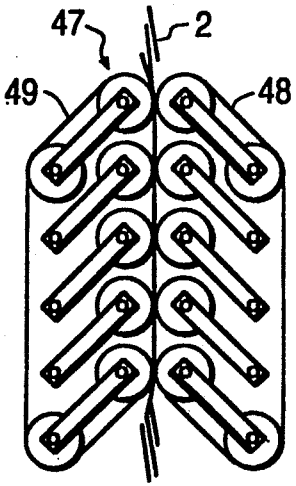
FIG. 4 is a view of a pressure device.

In order to separate printed products **12*a* that project to the right from printed products 12*b*, device 16 is arranged as shown in FIG. 3 so that stabbing fork 37 grips the projecting edge 12*a* and thus the printed products 12*a* run between belts 18 and 19 and are moved by them transversely to the conveying direction of the first conveyor path A. Printed products 12*a* are thus laterally pulled out of products 12*b* and are separated from the latter. On conveyor path B, a new overlapping stream is formed of separated products 12*a***, as mentioned above, which can be processed further as desired.

Device 16 is also suitable for the formation of so-called key bundles, in which case several devices 16 may be arranged one behind the other when seen in the conveying direction. In this case it is advantageous for the extension of carriages 24 to be cadenced since a precise, properly functioning removal of printed products is here particularly important.

It will be understood that the above description of the present invention is susceptible to various modifications, changes and adaptations, and the same are intended to be comprehended within the meaning and range of equivalents of the appended claims.

What is claimed is:

1. An apparatus for transferring printed products that are transported in an overlapping stream on a first conveyor path to a second conveyor path that is coplanar with the first conveyor path, wherein the first conveyor path includes a shoulder, the apparatus comprising a device for gripping a printed product, the device including a removal arm having two cooperating rollers which are movable between a first position and a second position, and a movable flap arranged ahead of the rollers, the flap being pivotal in the region of the shoulder between a position above the overlapping stream and a position below the overlapping stream, wherein the the two rollers are linearly movable back and forth in one plane and obliquely to the two conveyor paths, the apparatus further comprising a speed controlled cylinder-piston unit for moving the two cooperating rollers of the removal arm in at least one direction in a predetermined ratio to the transporting speed of the first conveyor path.

2. An apparatus as defined in claim 1, wherein the cylinder-piston unit is controlled such that at least the extraction speed of the two cooperating rollers is proportional to the transporting speed of the first conveyor path.

3. An apparatus as defined in claim 1, further comprising a telescope belt around each of the two cooperating rollers and the drive rollers for said telescope belts being connected with the drive of the-first conveyor path in a mechanically fixed transmission ratio.

4. An apparatus as defined in claim 1, further comprising a proportional valve connected with the cylinder-piston unit and with a tachometer of the drive of the first conveyor path for controlling at least the extraction speed of the two cooperating rollers.

5. An apparatus as defined in claim 1, wherein the device connects the two conveyor paths in a transverse direction and forms a turnout switch with which printed products of the first conveyor path can be continuously transferred to the second conveyor path.

6. An apparatus as defined in claim 1, wherein in the region of the shoulder, the first conveyor path is provided with a pressure device with which an overlapping stream of laterally offset folded together printed products can be gripped at one edge and the removal arm is disposed at the other edge in order to separate the printed products that have not been gripped.

* * * * *